US007051468B2

(12) United States Patent
Glock

(10) Patent No.: US 7,051,468 B2
(45) Date of Patent: May 30, 2006

(54) LOCKING DEVICE FOR A PISTOL

(76) Inventor: Gaston Glock, Klagenfurter Str. 32a, A-9220, Velden (AT)

( * ) Notice: Subject to any disclaimer, the term of this patent is extended or adjusted under 35 U.S.C. 154(b) by 23 days.

(21) Appl. No.: 10/757,075

(22) Filed: Jan. 14, 2004

(65) Prior Publication Data

US 2005/0115130 A1 Jun. 2, 2005

(30) Foreign Application Priority Data

Jan. 31, 2003 (AT) ..... A 152/2003

(51) Int. Cl.
*F41A 17/06* (2006.01)
*F41A 17/02* (2006.01)

(52) U.S. Cl. ..... 42/70.06; 42/70.04; 42/70.01

(58) Field of Classification Search ..... 42/70.01, 42/70.04, 70.05, 70.06
See application file for complete search history.

(56) References Cited

U.S. PATENT DOCUMENTS 2,945,316 A * 7/1960 Mulno ..... 42/66
4,261,127 A * 4/1981 Karkkainen ..... 42/70.11
4,754,568 A * 7/1988 Brandt ..... 42/70.06
5,081,779 A * 1/1992 Pack ..... 42/70.11
5,361,525 A * 11/1994 Bowes ..... 42/70.11
6,141,896 A * 11/2000 Oberst ..... 42/70.06
6,256,917 B1 * 7/2001 Findlay ..... 42/70.06
6,405,471 B1 * 6/2002 Mauch ..... 42/70.11
6,510,639 B1 * 1/2003 McMoore ..... 42/70.11
6,543,170 B1 * 4/2003 Beretta ..... 42/70.08

FOREIGN PATENT DOCUMENTS

DE 89 04 112 U 8/1989
WO WO 2002/070978 A1 9/2002

* cited by examiner

*Primary Examiner*—Michael J. Carone
*Assistant Examiner*—Bret Hayes
(74) *Attorney, Agent, or Firm*—Kilpatrick Stockton LLP

(57) ABSTRACT

The invention relates to a locking device for a pistol, for which by means of a cylinder lock (10, 11), which is arranged in the handle of the weapon behind the magazine shaft (21), a locking element (7, 19) can be brought from one position in which it extends into the path of motion of a part (20) of the trigger mechanism (4), into a position in which it does not hinder the motion of the trigger.

Figure 1:
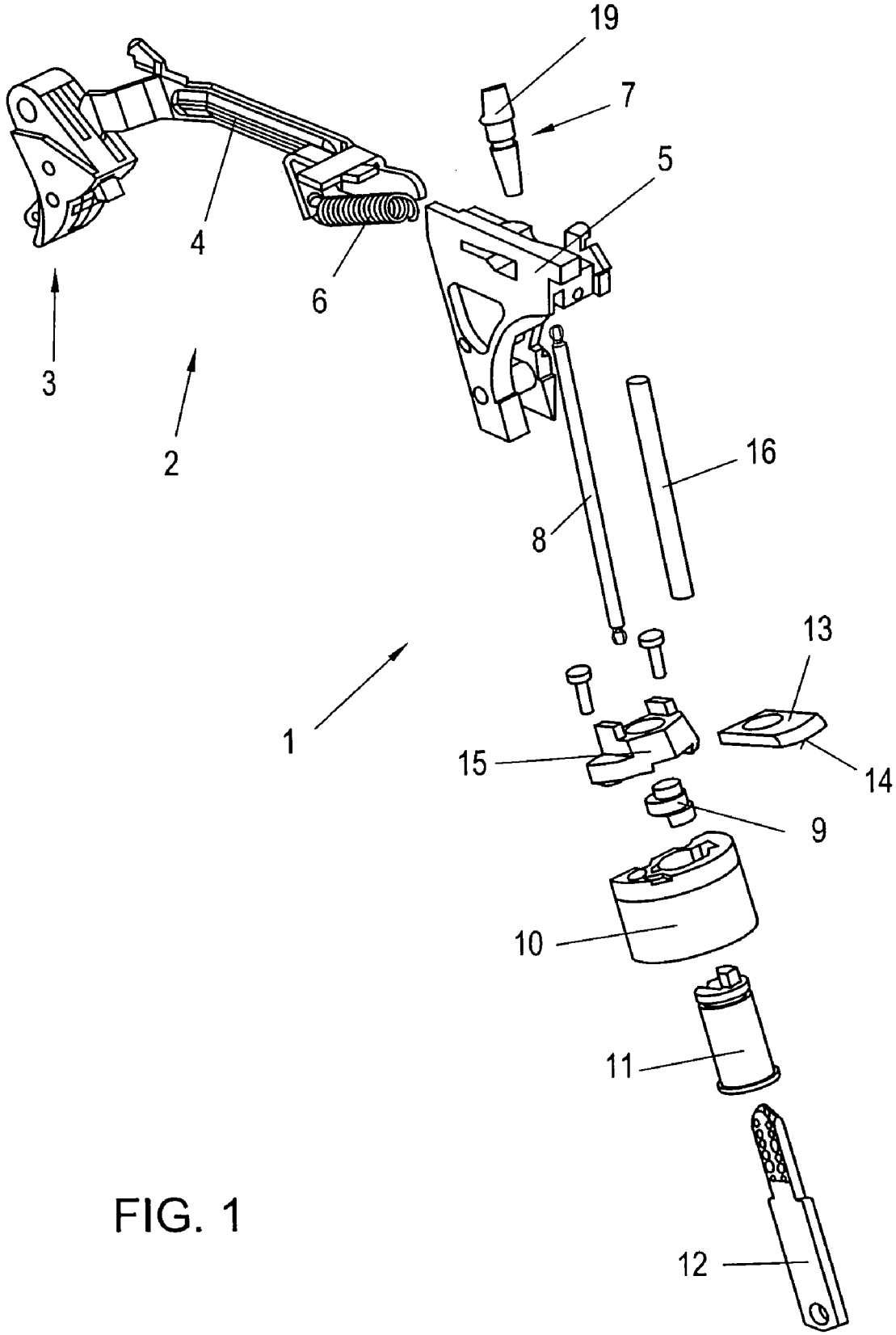

According to the invention, the moving parts (9, 8, 7) of the locking device execute purely rotational motions and preferably the locking element formed as a locking shaft (7) is provided over a section formed as a cam (19).

9 Claims, 6 Drawing Sheets

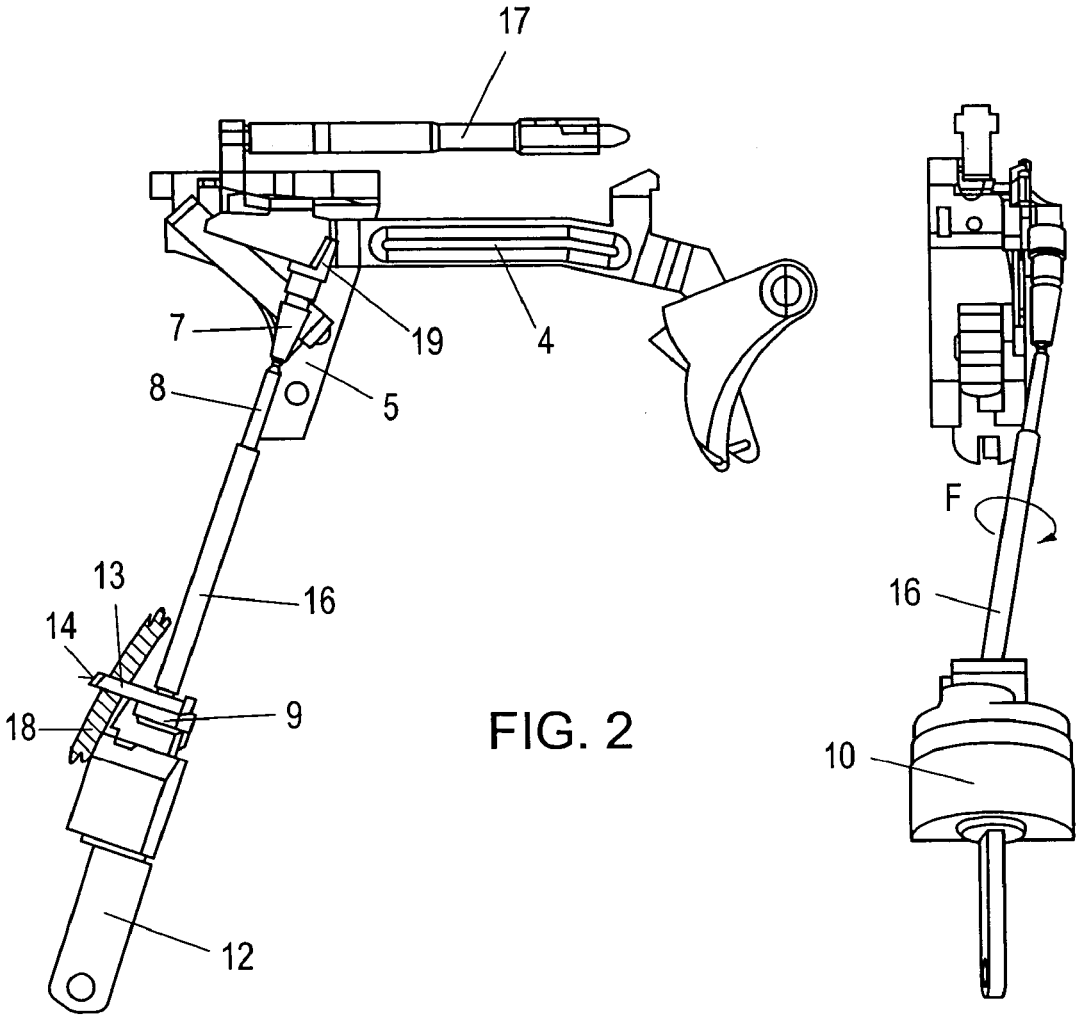
FIG. 2
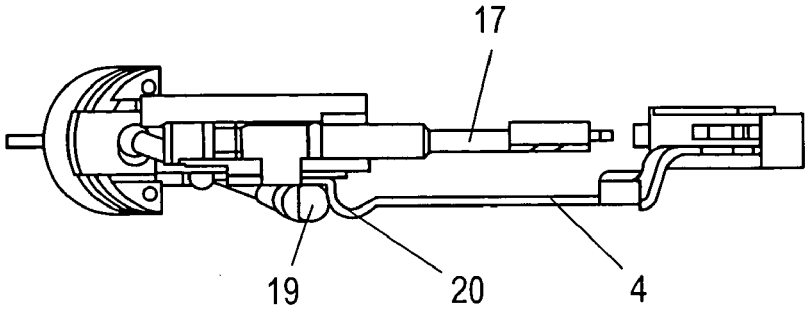

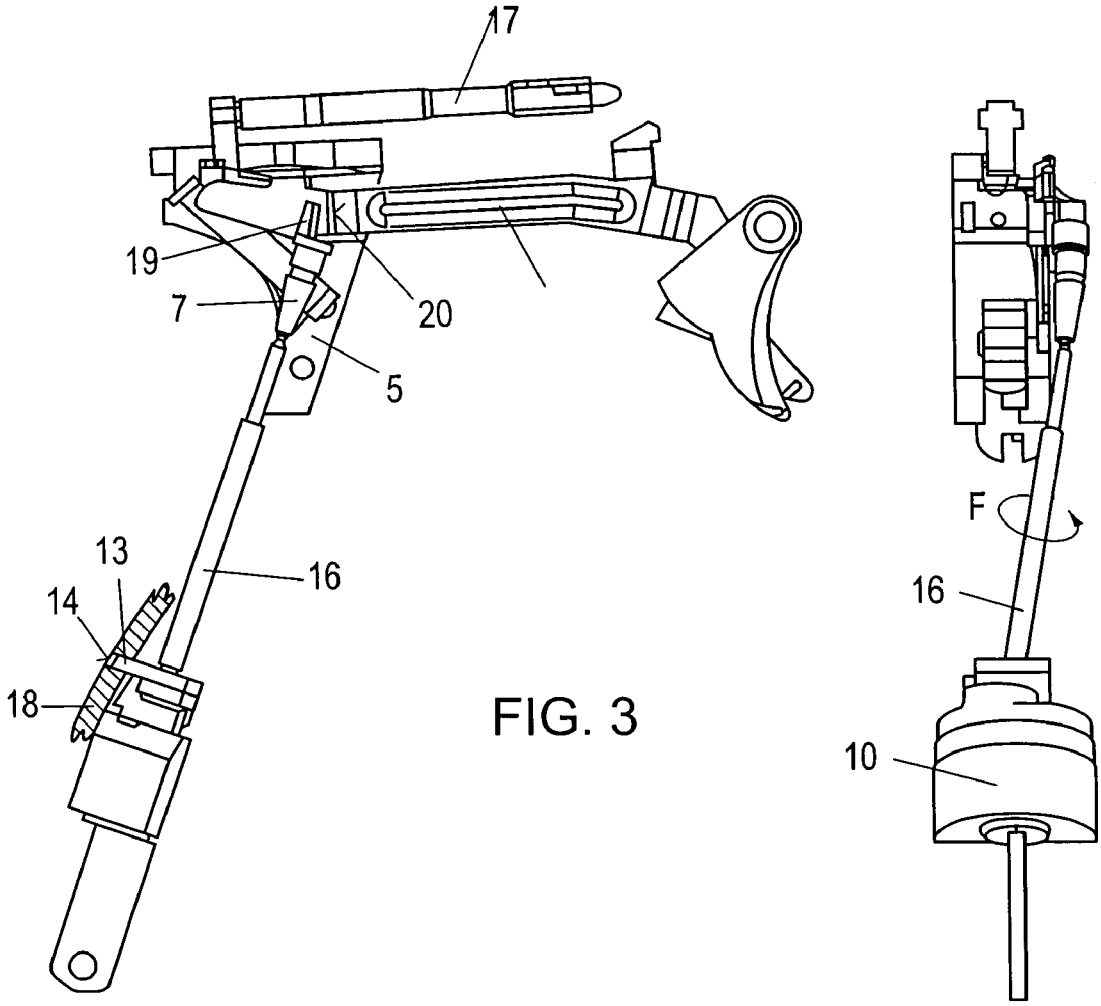
FIG. 3
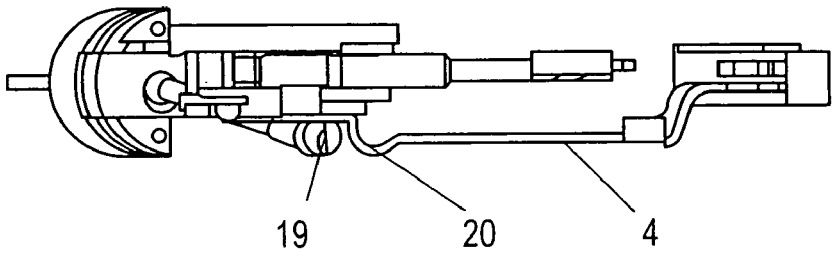

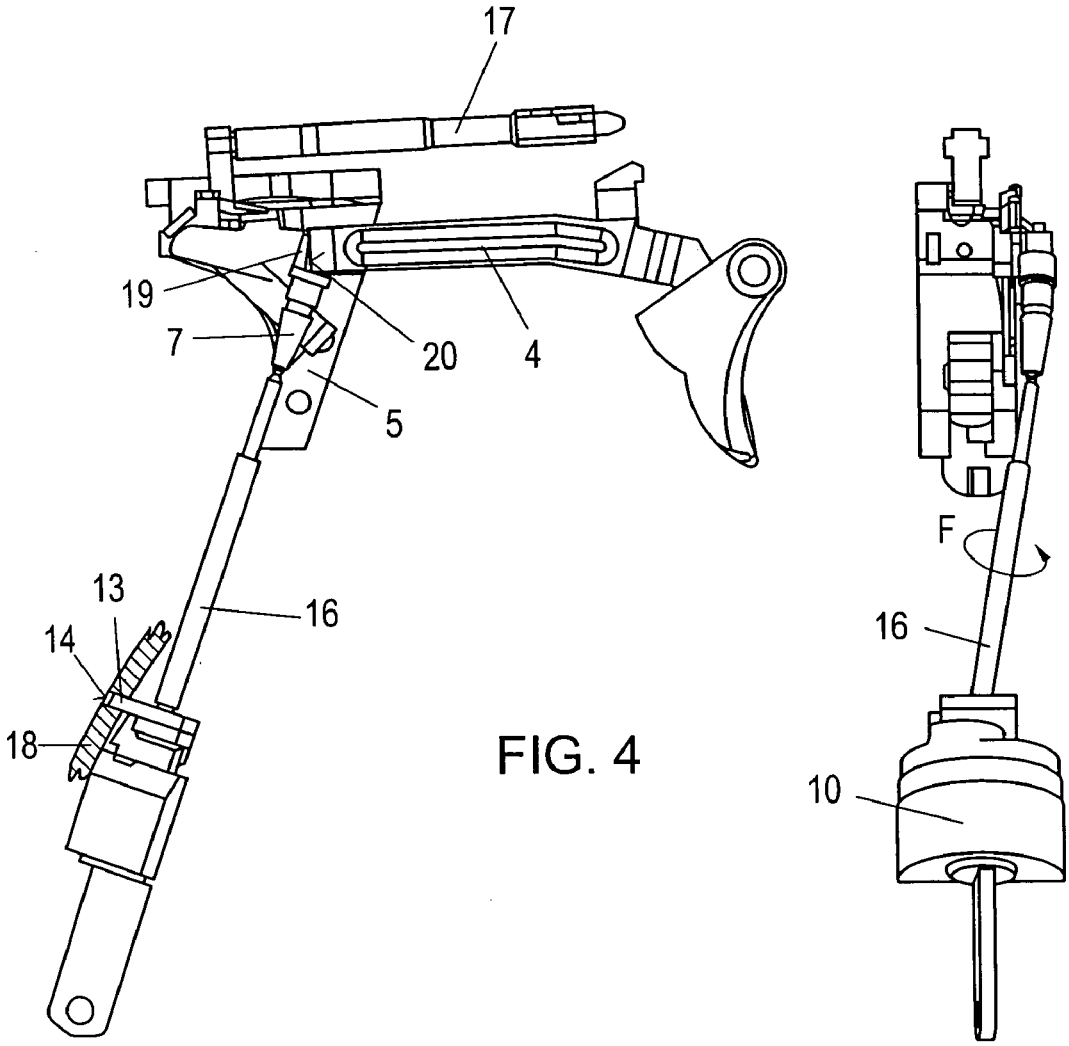
FIG. 4
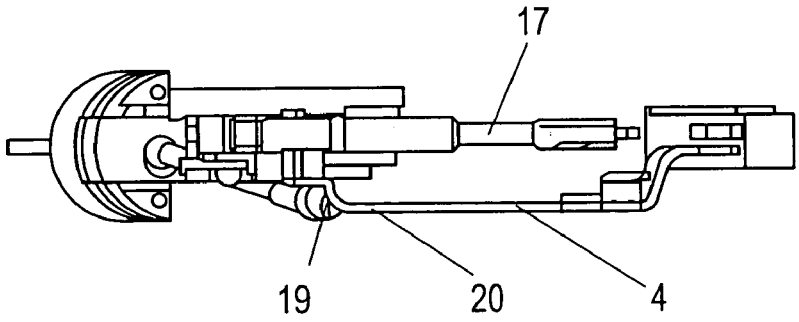

LOCKING DEVICE FOR A PISTOL

CROSS REFERENCE TO RELATED APPLICATIONS

This application claims priority to Austrian Patent Application No. A 152/2003 filed on Jan. 31, 2003, the contents of which are incorporated by reference herein.

The invention relates to a locking device for a pistol with a trigger, a trigger mechanism, and a firing pin, hammer, or the like, which is actuated by this mechanism, wherein the locking device contains a cylinder lock, which is arranged in the handle of the weapon, whose locking cylinder can be turned with a key, and which has a transmission mechanism of rods, levers, screws, and the like, wherein a locking element can be moved from a position where it is located outside of the path of motion of a part of the trigger mechanism of the pistol, into a position in which it projects into the path of motion of this part.

From DE 89 04 112 U, a locking device is known, which is provided in the lower part of a modified magazine and which pushes or also does not push a locking pin through aligned recesses in the rear wall of the magazine and the rear wall of the magazine shaft into the path of motion of the trigger mechanism. This device is complicated, expensive, and reduces the functionality of the weapon, because of increased weight, the number of cartridges in the magazine is reduced. In the end, this device does not actually achieve its purpose, because it is possible to destroy the magazine without damaging the weapon and consequently it is possible to use the weapon with a normal magazine.

Another locking device is known from WO 02/070978 A by the applicant. The contents of this publication are incorporated into the present application for reference. In this previously known locking device, the cylinder lock and at least parts of the transfer mechanism are arranged behind the magazine shaft. In the region of the cylinder lock, there is a crank guide with a helical path of motion, which converts the rotational movement of the cylinder lock into a linear movement, which is transferred over a rod to a locking element, which locks or releases the trigger mechanism according to the position of the cylinder lock.

This device has a reliable operation and cannot be deactivated by unauthorized persons without damaging the weapon. However, it has been shown that by selectively damaging the weapon, it is possible to deactivate the locking device without critically reducing the functionality of the weapon. It is definitely no longer possible to own a pistol modified in this way without suspicion or even to place it on the (legal) market, but it can still be used illegally. Here, it is necessary to saw off the back of the handle in the region of the rotating rod and thus to cut through the rotating rod. For this reason, the crank guide is complicated in production and requires maintenance.

The goal of the present invention is to solve these problems and to create a more improved locking device for pistols, especially one that cannot be manipulated without noticeable and destructive effects.

These goals are achieved according to the invention in that the activating rod transfers the locking motion or the release motion only through rotation and it is surrounded, preferably over at least essentially its entire length, by a sheath, which can rotate freely relative to this rod, which is seated loosely, and which is made from resistant material, preferably hard metal. In this way, one avoids all complicated and delicate gear-like devices, which convert the rotational movement of the key into a translational movement. In addition, if attempts are made to saw off the activating rod, it is no longer possible to reach this rod because while sawing, the hard-metal tube turns with the sawing motion without becoming damaged. Therefore, the locking device can no longer be deactivated by inconspicuous damage to the outer rear wall of the handle.

The invention will be explained in more detail with reference to the drawing. Shown here are FIG. 1, a locking device according to the invention in an exploded view, FIG. 2, the device of FIG. 1 assembled and integrated into the trigger mechanism of a pistol in the locked position, FIG. 3, the device of FIG. 2 in the same view, but in the released position, FIG. 4, the view of FIG. 3, but with a pulled trigger handle, FIGS. 5, 6, and 7, details, and FIG. 8, a schematic overall view.

From FIG. 1, a locking device according to the invention is shown in an exploded view. The entire device is located, in the assembled state, in the handle of a pistol 22 behind the magazine shaft 21, which is already known from WO 02/070978 A, whose FIG. 1 is contained in the present application as FIG. 8, and here requires no further explanation.

Figure 8:
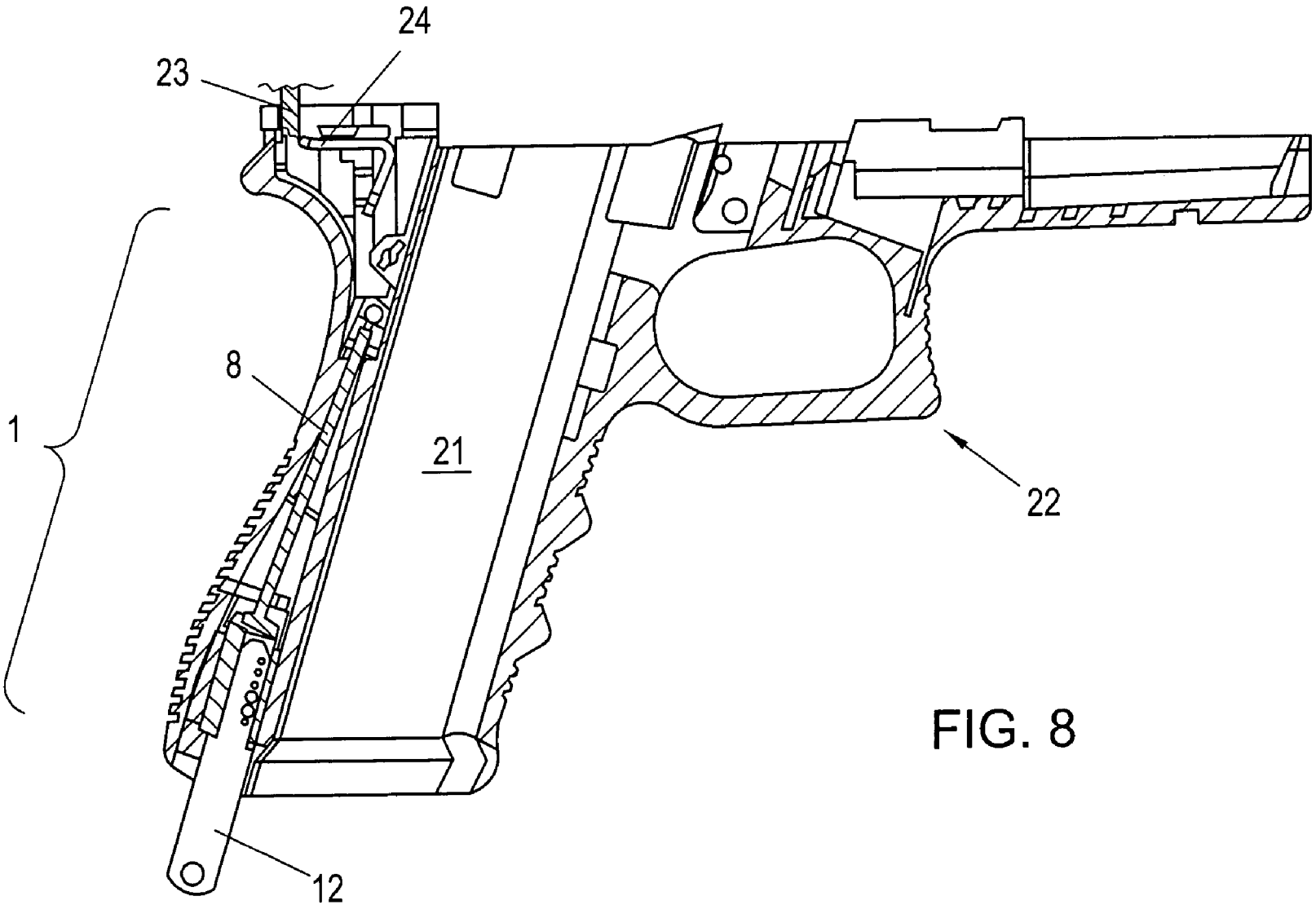

From FIG. 8, the position of a device 1 according to the invention in a pistol 22 can be seen, where the device shown here also corresponds to the state of the art. In this figure, a tab 23 of a firing pin 17 (FIG. 2) is also shown in contact with the associated activating element 24 of the trigger mechanism 2 (FIG. 1).

The construction of the device designated in its entirety with 1 is the following: a trigger mechanism 2 for a pistol 22 has a cock 3 (trigger guard) and a trigger slide 4. In a control block 5, the trigger motion, amplified by a trigger spring 6, is converted into the tension motion and the release motion for a firing pin 17. This mechanism has been known for a long time and has been proven effective. The invention is explained in the following with reference to this mechanism, without being restricted to use with this mechanism. According to the invention, a rotating locking shaft 7 is arranged in the region of the trigger motion of the trigger rod 4. The locking shaft 7 has a receiver at its lower end for a drive rod 8, with which it is connected so that the two parts are locked in rotation. The upper end of the locking shaft 7 carries a type of cam disk 19, e.g., in the shape of a semicircle.

The other, lower end of the drive rod 8 extends into the receiver of a stop piece 9, which is supported so that it can rotate in the recess of a lock receptacle 10. The lower end of the lock receptacle 10 is formed essentially aligned with the base of the handle of the pistol and has a receptacle for a rotor 11, which can be turned in the lock receptacle 10 by a matching key 12.

When the key 12 is turned, not only the rotor 11 and the stop piece 9, but also the drive rod 8 and consequently the locking shaft 7 turn in the same direction. At its upper end, the locking shaft 7 has a cam-like configuration 19, which will be referred to below.

The stop piece 9 has two cam-like disks, which are offset in height relative to each other. The lower of these disks is located at the height of the lock receptacle 10, while the upper disk is arranged above this. The lower cam disk interacts with stops in the lock receptacle and limits the rotation of the stop piece and thus the key and the locking shaft. The upper cam disk lies in a recess of a slide 13 and according to the angular position of the stop piece, a signal edge 14 of the slide 13 is separated from the rotational axis of the stop piece or pushed towards it.

The guidance of the slide 13 and the axial securing of the stop piece 9 is taken over by a lock cap 15, which is screwed on the matching lock receptacle 10.

Over the majority of the length of the drive rod 8 there is a sheath 16 loosely surrounding it, which preferably consists of extremely resistant material, e.g., hard metal, as will be explained in the following.

FIG. 2 shows the assembled device of FIG. 1 and also, for this purpose, a firing pin 17, and, in the region of the slide 13, the sheath of a handle piece 18. FIG. 12 [sic; 2] represents the locking device 1 according to the invention in the locked position, a position in which the full part of the cam section 19 of the locking shaft 7 is directed towards a projection or a shoulder 20 of the tension disk 4 and prevents any motion of the trigger slide 4 in the trigger direction. This can be seen especially clearly from the top view in FIG. 2.

The sheath 16, which sits loosely over the drive rod 8, now has the purpose, when the sheath 16 extends far enough in the region between the slide 13 and the (not shown) lock, that if an attempt is made to saw the weapon in order to destroy the drive rod or to fix the drive rod in its released position, then the saw pushes on the sheath 16 and turns the sheath freely with each sawing motion over the drive rod 8 without allowing the drive rod to be sawed through. This is realized, on the one hand, by placing the sheath 16 on the drive rod 8 with open space there between and, on the other hand, by making the sheath 16 preferably out of extremely hard material. This therefore achieves protection against manipulation and misuse, which can only be overcome by destroying a large area of the weapon in the rear region of the handle to allow the sheath 16 to be destroyed with pliers, a bolt cutter, or the like, and with it also the drive rod 8. The free movement of the sheath 16 about the drive rod 8 is indicated in the side view of FIG. 2 by the circular arrow F.

FIG. 3 shows this mechanism in the same views as FIG. 2, but with the locking device in the open, unlocked position.

The difference can be seen particularly in the top view, where the distance between the shoulder 20 of the trigger slide 4 and the cam section 19 of the locking shaft 7 can be seen. This distance is sufficient to tension the pistol with the completion of the trigger motion of the trigger slide 4, to release the firing pin, and thus to trigger the shot.

The slide 14 is pulled back into the position shown in FIG. 3 as a whole into the interior of the handle, in FIG. 2, in the locked position the slide surface 14 clearly extends over the surrounding surface of the handle piece 18, so that even in the dark it can be recognized just by holding the pistol on the handle piece whether the locking mechanism is in the locked or open position.

FIG. 4 shows the device of FIG. 3, wherein the locking device 1 is again in the open position, but the trigger mechanism is triggered, the trigger slide 4 is in its rearmost position, and the firing bolt 17 has just been released.

One can see in the front view, and also in the top view, that the trigger slide 4 also has enough space in its rearmost position in order not to collide with the facing side of the cam section 19 of the locking shaft 7, so that the functionality of the weapon is completely given.

Figure 7:
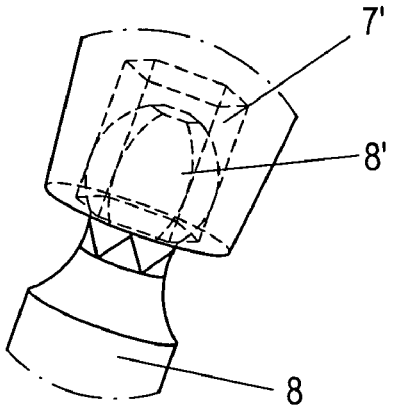
Figure 6:
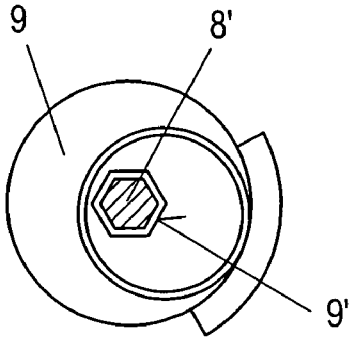
Figure 5:
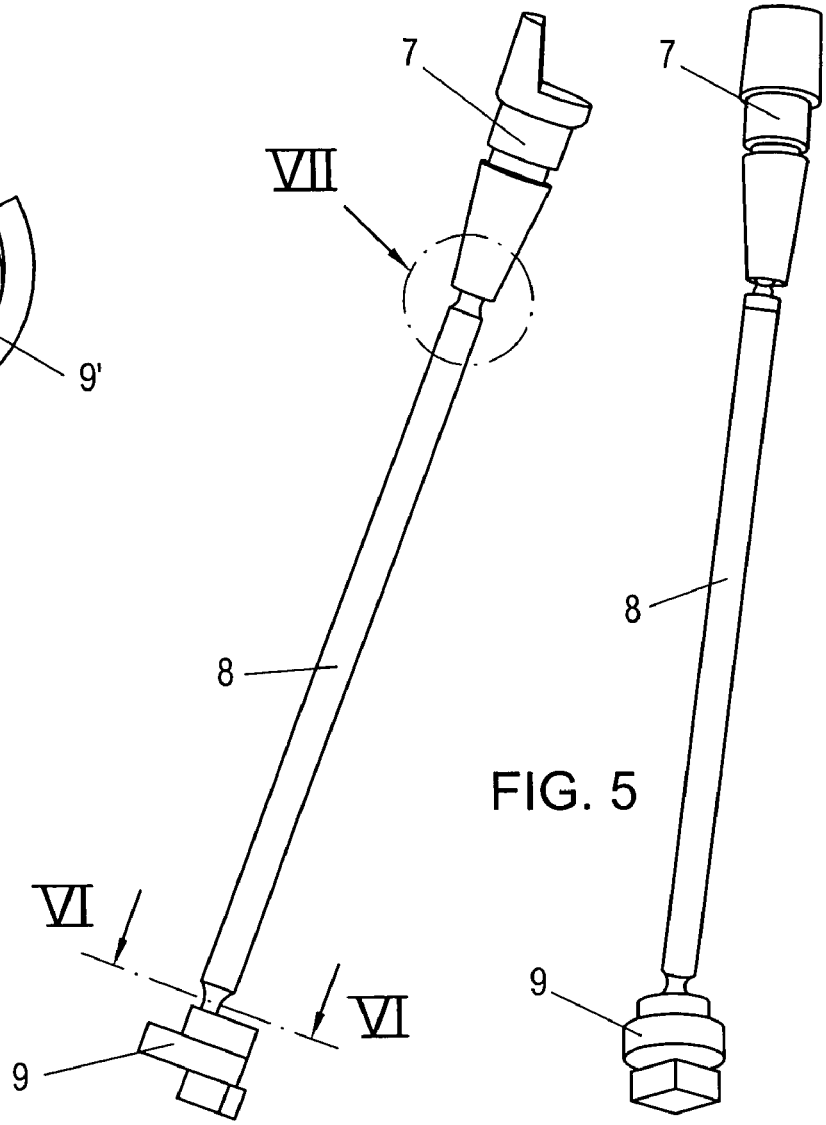

FIGS. 5, 6, and 7 show details of the drive rod 8, in particular its positioning on one side in the locking shaft 7, on the other side in the stop piece 9.

FIG. 6 shows a section along the line VI—VI of FIG. 5. One can see the two cam-shaped disks of the stop piece 8 and the lowermost region of the drive rod 8 shaped or worked into a hexagon. This region is not only polygonal, but also spherical, so that the inclined position of the axis of the drive rod 8 plays no role relative to the rotational axis of the stop piece 9. In addition, an axial displacement is secured by the polygonal-cylindrical receptacle in the stop piece 9.

Here, a more detailed description will be given: the drive rod 8 transfers the torque or rotation from the stop piece 9 to the locking element 7 and has, in the shown embodiment of FIG. 1, a region shaped or worked into a hexagon on both ends. In addition to the polygonal shape in each axial section, these regions are formed spherically in cross-section through the axis, so that also for unaligned axes, rotational movements can be transferred. Here, it concerns an equivalent or similar shape, as occurs for wrenches for socket head screws, which enable the rotation of corresponding socket head screws without requiring the axes to be aligned. While the polygonal-cylindrical shape of the receptacle in the stop piece 9 is made clear in FIG. 6, in FIG. 7 the main feature is the polygonal-spherical end of the drive rod 8.

With reference to the upper end of the drive rod 8, which interacts with the locking shaft 7 and is formed identically, this interaction becomes clear. The polygonal-spherical configuration can also be seen in FIG. 7, like the axial free space, which enables the problem-free length adaptation of the device to tolerances.

The invention is not limited to the illustrated embodiment but can be modified in various ways. It is essential that the motion between the locked position and the open position from the rotational movement of the key up to the motion of the actual locking element, in the shown embodiment the locking shaft 7, be purely rotational movements, through which complicated and delicate conversions from the rotational movement into a linear movement, in particular a conversion from the movement about an axis into an axial movement, are prevented. The arrangement of the sheath 16 as sawing protection is a valuable configuration, which guarantees, in simple and extremely reliable ways, that manipulation of the locking device is only possible after extensive damage to the weapon.

As materials for the locking mechanism according to the invention, any material can be used, which is typical for small firearms or materials, and which are typical for lock construction. Their selection does not represent a problem for someone skilled in the art of the invention.

The invention claimed is:

1. A locking device for a pistol with a trigger mechanism and a magazine shaft, comprising:

a cylinder lock arranged in a handle of the pistol, wherein the cylinder lock can be turned with a key;

a transfer mechanism capable of positioning a locking element in a path of portion of the trigger mechanism, wherein the transfer mechanism comprises a drive rod and a sheath, the sheath capable of rotating freely about the drive rod and extending over a portion of the axial length of the drive rod;

wherein the cylinder lock and the transfer mechanism are arranged adjacent to the magazine shaft, wherein the locking element and the transfer mechanism can rotate when the cylinder lock is turned.

2. The locking device according to claim 1, wherein the locking element comprises a cam region capable of extending into the path of portion of the trigger mechanism.

3. The locking device according to claim 1, wherein the sheath comprises a hard metal.

4. The locking device according to claim 1, wherein the drive rod comprises a polygonal-spherical shape adjacent to an end of the drive rod, wherein the shape is capable of extending into a complementarily formed recess associated with the locking element.

5. The locking device according to claim 2, wherein the locking shaft can rotate with respect to the handle of the pistol.

6. A locking device for a pistol with a trigger mechanism and a magazine shaft, comprising:

a cylinder lock positioned in a handle of the pistol, wherein the cylinder lock is capable of being rotated with a key;

a locking element comprising a cam region capable of extending into a path of a portion of the trigger mechanism;

a transfer mechanism capable of positioning the locking element from a first position outside of a path of a portion of the trigger mechanism, to a second position extending into the path of the portion of the trigger mechanism, the transfer mechanism comprising:

a drive rod; and a sheath capable of rotating about and extending over a portion of the drive rod;

wherein the cylinder lock and the transfer mechanism are arranged adjacent to the magazine shaft, and the transfer mechanism and locking element can rotate when the cylinder lock is rotated.

7. The locking device according to claim 6, wherein the sheath comprises a hard metal.

8. A locking device for a pistol with a trigger mechanism and a magazine shaft, comprising:

a cylinder lock positioned in a handle of the pistol, wherein the cylinder lock is capable of being rotated with a key;

a locking element comprising a cam region capable of extending into a path of a portion of the trigger mechanism;

a transfer mechanism capable of positioning the locking element from a first position outside of a path of a portion of the trigger mechanism, and to a second position extending into the path of the portion of the trigger mechanism, the transfer mechanism comprising:

a drive rod comprising a polygonal-spherical shape adjacent to an end of the drive rod, wherein the shape is capable of mounting to a complementarily formed recess associated with the locking element; and a sheath capable of rotating about and extending over a portion of the drive rod;

wherein the cylinder lock and the transfer mechanism are arranged adjacent to the magazine shaft, and the transfer mechanism and locking element can rotate when the cylinder lock is rotated.

9. The locking device according to claim 8, wherein the sheath comprises a hard metal.

* * * * *